US008474727B2

(12) United States Patent
Lee et al.

(10) Patent No.: US 8,474,727 B2
(45) Date of Patent: Jul. 2, 2013

(54) AIR CONDITIONER AND METHOD FOR CONTROLLING THE SAME

(75) Inventors: Ju Youn Lee, Seoul (KR); Baik Young Chung, Seoul (KR); Jae Dong Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 793 days.

(21) Appl. No.: 12/685,187

(22) Filed: Jan. 11, 2010

(65) Prior Publication Data

US 2010/0176208 A1 Jul. 15, 2010

(30) Foreign Application Priority Data

Jan. 12, 2009 (KR) ..... 10-2009-0002158

(51) Int. Cl.
*G05D 23/19* (2006.01)
*G05D 23/32* (2006.01)
*F24F 11/053* (2006.01)

(52) U.S. Cl.
USPC ..... 236/46 C; 236/1 C; 62/157

(58) Field of Classification Search
USPC ..... 62/157; 236/46 C, 46 R, 1 C, 91 R, 236/91 D
See application file for complete search history.

(56) References Cited

U.S. PATENT DOCUMENTS

2008/0295531 A1* 12/2008 Song et al. ..... 62/157

FOREIGN PATENT DOCUMENTS

| | | | |
|---|---|---|---|
| EP | 1811238 | A2 * | 7/2007 |
| EP | 1 998 118 | | 12/2008 |
| JP | 05187679 | A * | 7/1993 |
| JP | 2006-317074 | | 11/2006 |
| JP | 2008-304181 | | 12/2008 |
| KR | 10-2008-0096965 | | 11/2008 |

OTHER PUBLICATIONS

European Search Report dated May 7, 2010.

* cited by examiner

*Primary Examiner* — Chen Wen Jiang
(74) *Attorney, Agent, or Firm* — KED & Associates LLP

(57) ABSTRACT

An air conditioner and a method for controlling the air conditioner are provided. The air conditioner may include an air-conditioning device having a variety of components that provide air-conditioning of an indoor space, an input device that receives signals to manipulate the air-conditioning device and signals to select a sleep mode, and a controller that, when the input device receives a signal to select the sleep mode, controls the air-conditioning device to perform a rapid eye movement sleep operation at least one time to air-condition the indoor space at a temperature higher than a temperature that is set in accordance with the sleep mode.

21 Claims, 7 Drawing Sheets

AIR CONDITIONER AND METHOD FOR CONTROLLING THE SAME

The present application claims priority under 35 U.S.C. 118B and 35 U.S.C. 365 to Korean Patent Application No. 10-2009-0002158 filed in Korea on Jan. 12, 2009, which is hereby incorporated by reference in its entirety.

BACKGROUND

1. Field

An air conditioner and a method for controlling the air conditioner are disclosed herein.

2. Background

An air conditioner is an appliance that cools or heats an indoor space. However, related art air conditioners have limitations in that they cannot fulfill a variety of requirements of sleepers.

BRIEF DESCRIPTION OF THE DRAWINGS

Embodiments will be described in detail with reference to the following drawings in which like reference numerals refer to like elements, and wherein.

DETAILED DESCRIPTION

Figure 1:
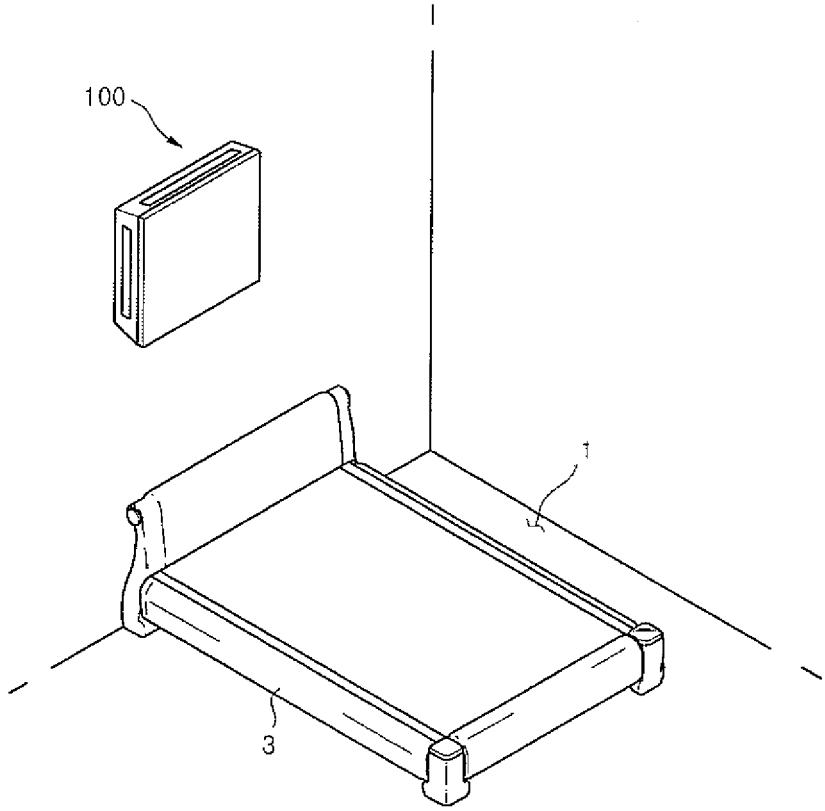
FIG. 1 is a perspective view of an air conditioner according to an embodiment.

Reference will now be made in detail to embodiments, examples of which are illustrated in the accompanying drawings. Where possible, like reference numerals have been used throughout the drawings to refer to the same or like elements.

Figure 2:
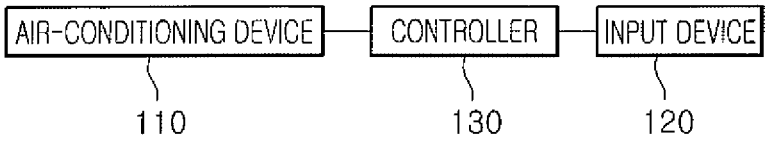
FIG. 2 is a block diagram of an air conditioner according to an embodiment.

FIG. 1 is a perspective view of an air conditioner according to an embodiment, and FIG. 2 is a block diagram of an air conditioner according to an embodiment. Referring to FIG. 1, an air conditioner 100 according to an embodiment may be installed at a side of an indoor space 1. For example, in FIG. 1, the air conditioner 100 is shown installed on a wall surface above a head portion of a bed 3.

Referring to FIG. 2, the air conditioner 100 may include an air-conditioning device 110, an input device 120, and a controller 130. The air-conditioning device 110 may include a variety of components, such as a compressor, an indoor device, and like components for air-conditioning a room, such as a bedroom. Since the structure of the air-conditioning device is well known in the art, detailed description will be omitted herein.

The input device 120 may receive signals such as, for example, a signal for setting a cooling temperature and a signal for controlling an air volume. In addition, the input device 120 may receive a signal for setting a sleep mode. For example, the input device 120 may receive a signal for selecting the sleep mode, and setting a sleep time in units of hours or minutes.

The controller 130 may control the air-conditioning device 110 in accordance with the signal(s) input to the input device 120 by, for example, a user. That is, the controller 130 may control the air-conditioning device 110 in accordance with an air-conditioning temperature and time input to the input device 120.

When the signal for selecting the sleep mode and the signal for setting the sleep time are input to the input device 120, the controller 130 may control the air-conditioning device to perform a sleep entry operation, a sleep operation, a first rapid eye movement (REM) sleep operation, a sleep operation, and a second REM sleep operation. REM sleep means sleep accompanying a rapid eye movement. Generally, sleep is classified into REM sleep and non-REM sleep. REM sleep is maintained for a predetermined period of time at intervals of a predetermined time. Generally, REM sleep is maintained for approximately 20-40 minutes at intervals of approximately 90-110 minutes. However, the intervals and time of REM sleep may differ depending on the sleeper. It is well known that sufficient sleep effect cannot be attained when a sleeper can not get into a deep enough sleep to reach REM sleep.

In more detail, when the sleep time input to the input device 120 initiates, the controller 130 may control the air-conditioning unit 110 to perform the sleep entry operation until it reaches a preset sleep entry time t0. When it reaches the sleep entry time t0, the controller 130 may control the air-conditioning device 110 to perform the sleep operation for a preset first REM sleep operation time dt1. When the first REM sleep operation time dt1 has elapsed, the controller 130 may control the air-conditioning device 10 to repeatedly perform the sleep operation and the first REM sleep operation a plurality of times (2 times in FIG. 5). Meanwhile, when the air-conditioning device 110 completes the first REM sleep operation, the controller 130 may control the air-conditioning device 110 to perform the sleep operation until it reaches a second REM sleep time t2. When it reaches the second REM sleep time t2, the controller 130 may control the air-conditioning device 110 to perform the second REM sleep operation for a preset second REM sleep operation time dt2. When the second REM sleep operation time has elapsed, the sleep mode may be performed until the sleep time has elapsed.

Meanwhile, the controller 130 may control the air conditioning device 110 to air-condition the indoor space 1 at a predetermined sleep entry temperature T1, a sleep temperature T0, and an REM sleep temperature T2 in, respectively, the sleep entry operation, the sleep operation, and the first and second REM sleep operations. The sleep temperature T0 may be set to be the same as a temperature of the sleep mode input to the input device 120. Further, the sleep entry temperature T1 may be set to be less than the sleep temperature T0, and the REM sleep temperature T2 may be set to be higher than the sleep temperature T0. That is, since sleep initiates in the sleep entry operation, the sleeper may more quickly fall asleep by setting the sleep entry temperature T1 less than the sleep temperature T0. Since the autonomic nerve of the sleeper cannot be efficiency controlled during the REM sleep, the body temperature of the sleeper may be maintained by setting the REM sleep temperature T2 higher than the sleep temperature T0. In this embodiment, the sleep entry temperature T1 may be set to be less than the sleep temperature T0 by approximately 1-3° C., for example, approximately 2° C. The REM sleep temperature T2 may be set to be higher than the sleep temperature T0 by approximately 0.5-1.5° C., for example, approximately 1.0° C.

The sleep entry time t0 may be an amount of it takes for the sleeper to get to sleep after the sleep time initiates. In this embodiment, the sleep entry time t0 is set as approximately by 5-15 minutes, for example, approximately 10 minutes, after the sleep time initiates has elapsed.

The first and second REM sleep times t1, t1', t1", and t2, and the first and second REM sleep operation times dt1 and dt2 may be set according to the above-described REM sleep features. That is, the first and second REM sleep times t1, t1', t1", and t2, and the first and second REM sleep operation times dt1 and dt2 may be set corresponding to the REM sleep intervals and times of the respective sleepers. In this embodiment, the first REM sleep times t1, t1', and t1" are set as times at intervals of approximately 90-110 minutes, for example, approximately 100 minutes. The second REM sleep time t2 is set as a time after approximately 60-80 minutes, for example, approximately 70 minutes, have elapsed after the final first REM sleep time t1" among the first REM sleep times t1, t1', and t1". In addition, the first and second REM sleep operation times Δt1, Δt1', Δt1" and Δt2 are set as approximately 20-40 minutes, for example, approximately 30 minutes.

A method for controlling an air conditioner according to an embodiment will be described in more detail hereinbelow.

Figure 3:
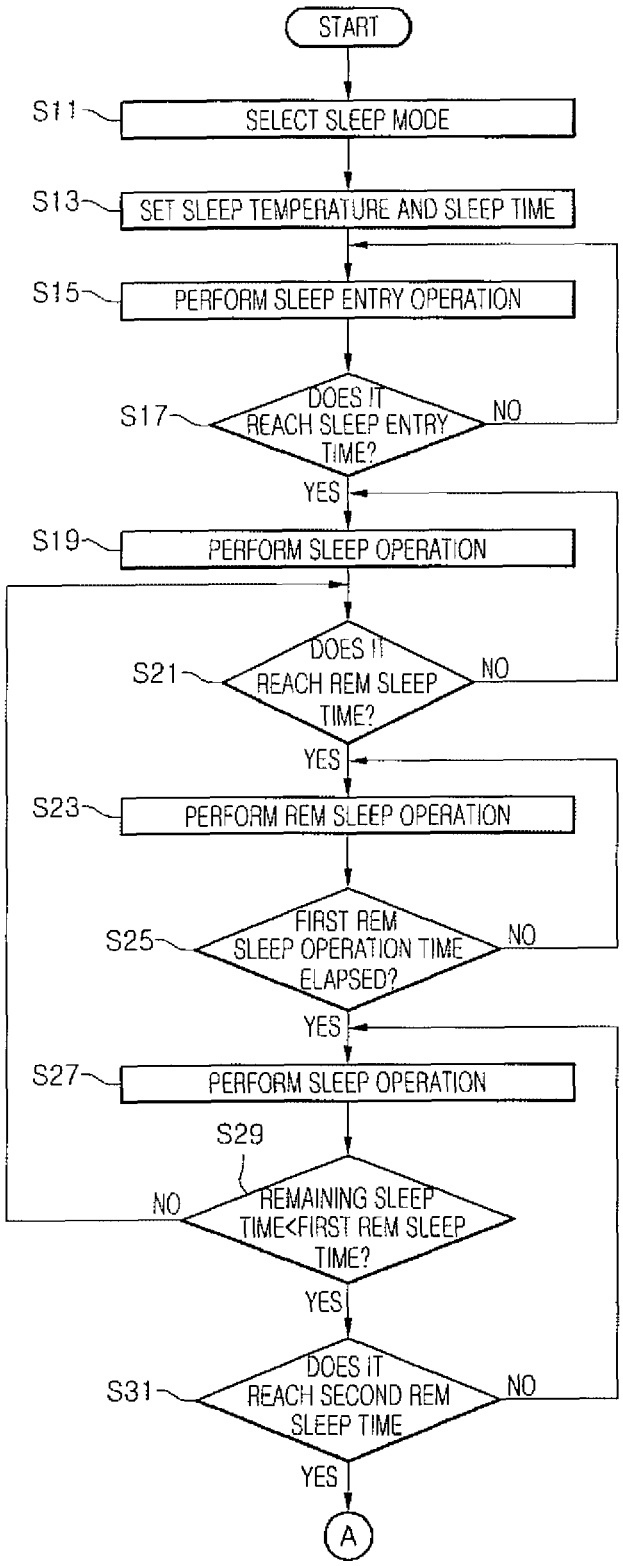
FIGS. 3 and 4 are flowcharts illustrating a method for controlling an air conditioner according to an embodiment.
Figure 4:
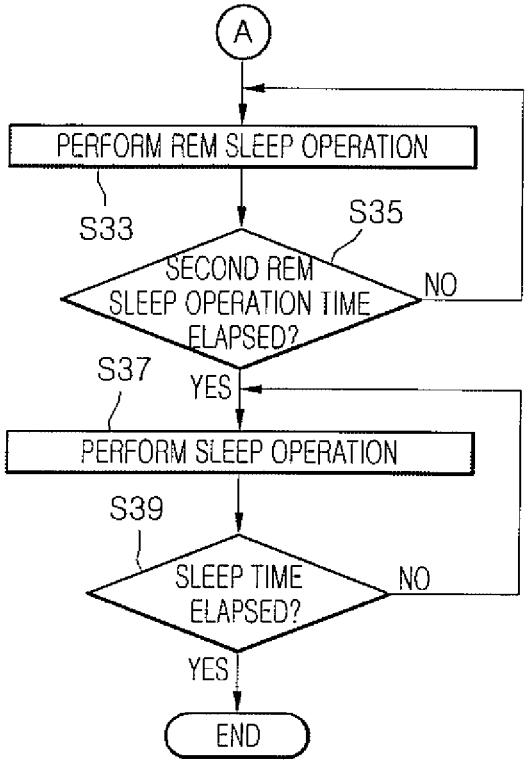
Figure 5:
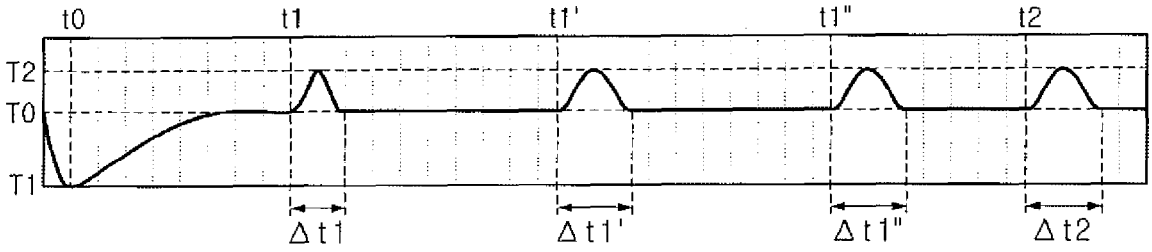
FIG. 5 is a graph illustrating a temperature variation according to an embodiment.
Figure 6:
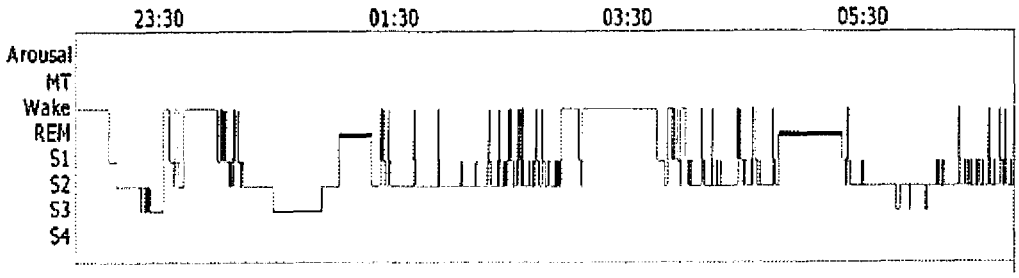
FIG. 6 is a graph illustrating brainwaves of a user in a sleep state when indoor air is air-conditioned by a related art air conditioner.
Figure 7:
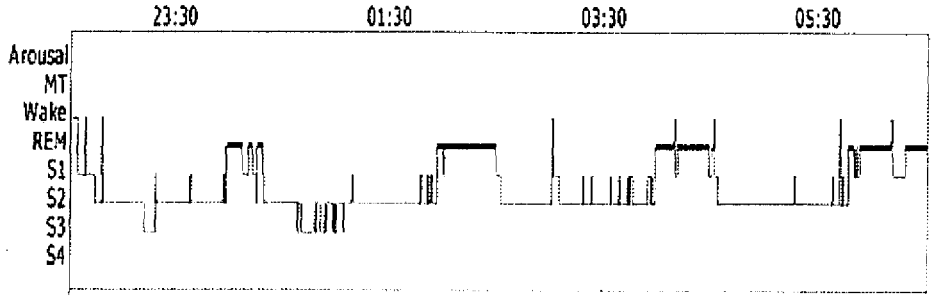
FIG. 7 is a graph illustrating brainwaves of a user in a sleep state when indoor air is air-conditioned by an air conditioner according to an embodiment.

FIGS. 3 and 4 are flowcharts illustrating a method for controlling an air conditioner according to an embodiment. FIG. 5 is a graph illustrating a temperature variation according to an embodiment. FIG. 6 is a graph illustrating brainwaves of a user in a sleep state when indoor air is conditioned by a related art air conditioner, while FIG. 7 is a graph illustrating brainwaves of a user in a sleep state when indoor air is conditioned by an air conditioner according to an embodiment.

Referring to FIGS. 3 and 4, the input device 120 may receive a signal for selecting a sleep mode, in step S11. Next, the input device 120 may receive signals for setting the sleep temperature T0 and sleep time, in step S13. In this embodiment, the sleep temperature T0 is approximately 26° C. and the sleep time is approximately 390 minutes. However, embodiments are not so limited.

Meanwhile, when the input device 120 receives the signals for selecting the sleep mode, the sleep temperature, and the sleep time, the controller 130 may control the air-conditioning device 110 to perform the sleep entry operation, in step S15. Therefore, the indoor space 1 may be air-conditioned at the sleep entry temperature T1 of approximately 24° C. until it reaches the sleep entry time t0 after the sleep time initiates, for example, for approximately 10 minutes.

Further, the controller 130 may determine if the sleep entry time t0 has been reached, in step S17. When it is determined that the sleep entry time t0 has been reached, the controller 130 may control the air-conditioning device 110 to perform the sleep operation, in step S19. Therefore, the indoor space 1 may be air-conditioned at the sleep temperature T0 of approximately 26° C.

Next, the controller 130 may determine if the first REM sleep time t1 has been reached, in step S21. When it is determined that the first REM sleep time t1 has been reached, the controller 130 may control the air-conditioning device 110 to perform the first REM sleep operation, in step S23. Therefore, the indoor space 1 is air-conditioned for the first REM sleep operation time dt1 at the temperature T2 of approximately 27° C.

Further, the controller 130 may determine if the first REM sleep operation time dt1 has elapsed, in step S25. When the first REM sleep operation time dt1 has elapsed, the controller 130 may control the air-conditioning device 110 to perform the sleep operation, in step S27.

Meanwhile, the controller 130 may determine if a remaining sleep time at present is less than the first REM sleep times t1' and t1", in step S29. When it is determined that the remaining sleep time at present is less than the first REM sleep times t1' and t1", the controller 130 may determine if the second REM sleep time t2, has been reached, in step S31. When it is determined that the second REM sleep time t2 has been reached, in step S31, the controller 130 may control the air-conditioning device to perform the second REM sleep operation, in step S33. Accordingly, the indoor space 1 may be air-conditioned at the REM sleep temperature T2 of approximately 27° C. for the second REM sleep operation time dt2.

The controller 130 may determine if the second REM sleep operation time dt2 has elapsed, in step S35. When it is determined that the second REM sleep operation time dt2 has elapsed, the controller 130 may control the air-conditioning device 110 to perform the sleep operation, in step S37.

Finally, the controller 130 may determine if the sleep time has elapsed, in step S39. When it is determined that the sleep time has elapsed, the sleep mode is finished.

Meanwhile, when it is determined in Step S29 that the remaining sleep time is equal to or greater than the first REM sleep times t1' and t1", Steps 21 to 27, for example, the first REM sleep operation and sleep operation may be performed. The repeated performance of the first REM sleep operation and the sleep operation may be continued it is determined that the remaining sleep time is less than the first REM sleep times t1' and t1".

When the sleep mode is performed as described above, the temperatures of the indoor space 1 may be as shown in FIG. 5. That is, the temperature of the indoor space in the sleep entry operation may be reduced. When the sleep entry operation is finished, the temperature of the indoor space 1 may increase and be maintained at a predetermined level. Further, in the first and second REM sleep operations, the temperature of the indoor space 1 may increase again.

FIG. 6 is a graph illustrating brainwaves of a user in a sleep state when indoor air is conditioned by a related art air conditioner, while FIG. 7 is a graph illustrating brainwaves of a user in sleep state when indoor air is conditioned by air conditioner according to embodiment. The brainwaves of the user in the graph of FIG. 7 show that the wakeup state of the user is significantly reduced as compared to the graph of FIG. 6.

As described above, according to the air conditioner and the method for controlling the air conditioner according to embodiments, a sleeper may more efficiently get sleep, especially in REM sleep.

One embodiment provides an air conditioner and a method for controlling the air conditioner that can allow a sleeper to more efficiently get sleep.

In one embodiment, an air conditioner is provided which may include an air-conditioning unit or device comprising a variety of components for air-conditioning of an indoor space; an input unit or device that receives signals for manipulating the air-conditioning unit and signals for selecting a sleep mode; and a control unit or controller that controls such that, when the input unit receives the signal for selecting the sleep mode, the air-conditioning unit performs rapid eye movement sleep operation by at least one time to air-condition the indoor space at a temperature higher than a temperature that is set in accordance with the sleep mode.

In another embodiment, an air conditioner is provided which may include an air-conditioning unit or device comprising a variety of components for air-conditioning of an indoor space; an input unit or device that receives signals for setting a sleep time and a sleep temperature; and a control unit or controller that controls operation of the air-conditioning unit according to the sleep time and temperature input to the input unit, wherein, when the sleep mode initiates, the indoor space is air-conditioned at a temperature less than the sleep temperature until it reaches a sleep entry time; the indoor space is air-conditioned at the sleep temperature when it reaches the sleep entry time; and the indoor space is air-conditioned at a temperature higher than the sleep temperature for a preset rapid eye movement sleep operation time at intervals of the preset rapid eye movement sleep time in the course where the indoor space is air-conditioned at the sleep temperature.

In still another embodiment, a method is provided for controlling an air conditioner and may include an air-conditioning unit or device that air-conditions an indoor space, an input unit or device that receives signals for setting air-conditioning temperature and time for the indoor space, and a control unit or controller that controls operation of the air-conditioning unit, including allowing the air-conditioning unit to air-condition the indoor space at a temperature less than the air-conditioning temperature in a sleep entry step; allowing the air-conditioning unit to air-condition the indoor space at the air-conditioning temperature in a sleep operation step; and allowing the air-conditioning unit to air-condition the indoor space at a rapid eye movement sleep temperature higher than the air-conditioning temperature in a rapid eye movement sleep operation step, wherein the sleep operation step and the rapid eye movement sleep operation step are alternately repeatedly performed until the operation time has elapsed.

According to the embodiments, the user can efficiently get sleep.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

an air-conditioning device that air-conditions an indoor space;

an input device configured to receive signals for manipulating the air-conditioning device and a signal for selecting a sleep mode; and a controller that, when the input device receives the signal for selecting the sleep mode, controls the air-conditioning device to perform a rapid eye movement (REM) sleep operation at least one time to air-condition the indoor space at a temperature higher than a temperature set in accordance with the sleep mode, wherein the rapid eye movement (REM) sleep operation comprises:

a first rapid eye movement (REM) sleep operation that is performed at least one time at an interval of a predetermined time during a process for performing the sleep mode; and a second rapid eye movement (REM) sleep operation that is performed at least one time at an interval of a predetermined time after the first rapid eye movement sleep operation is finished, and wherein the second rapid eye movement (REM) sleep operation is performed when a remaining sleep time at present is less than the first rapid eye movement (REM) sleep time.

2. The air conditioner according to claim 1, wherein the REM sleep operation is performed a plurality of times for a period of time corresponding to a REM cycle during a process for performing the sleep mode.

3. The air conditioner according to claim 1, wherein the REM sleep operation is performed a plurality of times at preset time intervals.

4. The air conditioner according to claim 1, wherein the REM sleep operation is performed at intervals of approximately 60-110 minutes during a process for performing the sleep operation.

5. The air conditioner according to claim 1, wherein the first REM sleep operation is performed at least one time at an interval of approximately 90-100 minutes during a process for performing the sleep mode, and the second REM sleep operation is performed at least one time at an interval of approximately 60-80 minutes after the first REM sleep operation is finished.

6. The air conditioner according to claim 1, wherein, in the REM sleep operation, the air-conditioning device air-conditions the indoor space at a temperature higher than the temperature set in accordance with the sleep mode by approximately 1° C.

7. The air conditioner according to claim 1, wherein the REM sleep operation is performed for approximately 20-40 minutes.

8. The air conditioner according to claim 1, wherein, when the signal for selecting the sleep mode is input to the input device, the controller controls the air-conditioning device to perform a sleep entry operation, in which the indoor space is air-conditioned at a temperature lower than the temperature set in accordance with the sleep mode, before performing the sleep operation.

9. The air conditioner according to claim 8, wherein, in the sleep entry operation, the air-conditioning device air-conditions the indoor space at a temperature lower than the temperature set in accordance with the sleep mode by approximately 2° C.

10. The air conditioner according to claim 8, wherein the sleep entry operation is performed for approximately 5-15 minutes.

11. The air conditioner according to claim 1, wherein the sleep mode comprises:

a sleep entry time set by the user; and a sleep temperature desired by the user, wherein, when the sleep mode initiates, the indoor space is air-conditioned at a temperature less than the sleep temperature until the sleep entry time is reached, the indoor space is air-conditioned at the sleep temperature when the sleep entry time is reached, and the indoor space is air-conditioned at a temperature higher than the sleep temperature for a preset rapid eye movement (REM) sleep operation period of time at predetermined intervals.

12. The air conditioner according to claim 11, wherein the indoor space is air-conditioned at a temperature less than the sleep temperature by approximately 2° C. until the sleep entry time is reached.

13. The air conditioner according to claim 11, wherein the indoor space is air-conditioned at a temperature higher than the sleep temperature by approximately 1° C. for the REM sleep operation period of time.

14. The air conditioner according to claim 11, wherein the sleep entry time is a time approximately 10 minutes after the sleep mode initiates.

15. The air conditioner according to claim 11, wherein the REM sleep operation is set at intervals of approximately 90-110 minutes.

16. The air conditioner according to claim 11, wherein, when a remaining sleep time after the sleep mode initiates is greater than approximately 100 minutes, the REM sleep operation is set to be approximately 100 minutes and, when the remaining sleep time is less than approximately 100 minutes, the REM sleep operation is set to be approximately 70 minutes.

17. The air conditioner according to claim 11, wherein the REM sleep operation period of time is set to be approximately 30 minutes after the REM sleep time is reached.

18. A method for controlling an air conditioner comprising an air-conditioning device that air-conditions an indoor space, an input device configured to receive signals for setting an air-conditioning temperature and time for the indoor space, and a controller that controls operation of the air-conditioning device, the method comprising:

controlling the air-conditioning device to air-condition the indoor space at a temperature less than the air-conditioning temperature during a sleep entry operation;

controlling the air-conditioning device to air-condition the indoor space at the air-conditioning temperature during a sleep operation; and controlling the air-conditioning device to air-condition the indoor space at a rapid eye movement (REM) sleep temperature higher than the air-conditioning temperature during a REM sleep operation, wherein the REM sleep operation comprises:

performing a first REM sleep operation if a first REM sleep time is reached;

determining that a remaining sleep time at present is less than the first REM sleep time; and performing a second REM sleep operation if the remaining sleep time at present is less than the first REM sleep time.

19. The method according to claim 18, wherein the sleep entry temperature is less than the air-conditioning temperature by approximately 2° C., and wherein the REM sleep temperature is higher than the air-conditioning temperature by approximately 1° C.

20. The method according to claim 18, wherein the first REM sleep operation is performed at least one time at an interval of approximately 90-100 minutes during a process for performing the sleep mode, and the second REM sleep operation is performed at least one time at an interval of approximately 60-80 minutes after the first REM sleep operation is finished.

21. The method according to claim 18, wherein the sleep operation and the REM sleep operation are alternately performed until an operation time has elapsed.

* * * * *